US006217406B1

(12) United States Patent
Ross

(10) Patent No.: US 6,217,406 B1
(45) Date of Patent: Apr. 17, 2001

(54) WIRE SKELETON FOR SOFT SCULPTURED DOLLS

(76) Inventor: Shawna Dan'iel Ross, P.O. Box 55185, Tulsa, OK (US) 74155

( * ) Notice: Subject to any disclaimer, the term of this patent is extended or adjusted under 35 U.S.C. 154(b) by 0 days.

(21) Appl. No.: 09/273,650

(22) Filed: Mar. 23, 1999

(51) Int. Cl.[7] ..... A63H 3/02; A63H 3/04; F16C 11/06

(52) U.S. Cl. ..... 446/370; 446/373; 446/385

(58) Field of Search ..... 446/268, 369, 446/370, 374, 375, 378, 371, 373, 385; 403/150, 152, 154, 155, 157

(56) References Cited

U.S. PATENT DOCUMENTS

| | | | | |
|---|---|---|---|---|
| 1,832,584 | * | 11/1931 | Rogers, Jr. . | |
| 1,841,855 | * | 1/1932 | Steiff . | |
| 2,940,800 | * | 6/1960 | Knapp . | |
| 3,807,086 | | 4/1974 | Schleich | 46/115 |
| 4,136,484 | | 1/1979 | Abrams | 46/160 |
| 4,197,358 | | 4/1980 | Garcia | 428/542 |
| 4,233,775 | | 11/1980 | Neufeld | 46/151 |
| 4,954,118 | * | 9/1990 | Rafabert . | |
| 4,964,836 | | 10/1990 | Kamei | 446/374 |
| 5,017,173 | | 5/1991 | Shapero et al. | 446/374 |
| 5,288,257 | | 2/1994 | Zacherl | 446/72 |

FOREIGN PATENT DOCUMENTS

| | | | | |
|---|---|---|---|---|
| 382589 | * | 10/1923 | (DE) | 446/370 |
| 1244459 | * | 9/1960 | (FR) | 446/370 |

* cited by examiner

*Primary Examiner*—Robert A. Hafer
*Assistant Examiner*—Laura Fossom
(74) *Attorney, Agent, or Firm*—Molly D. McKay

(57) ABSTRACT

A wire skeleton for a soft sculptured doll comprised of a wire backbone member that extends into the head of the doll and secures within an upward extending sleeve of an inverted t-shaped connector and a unshaped wire that extends through the two sleeves in the horizontal portion of the t-shaped connector to form the leg members of the doll's skeleton. The unshaped wire freely rotates within the t-shaped connector, allowing the leg members to rotate in unison forward and backward on the doll. Also, backbone member and each of the leg members can be bent to pose the doll. Dolls are formed around the wire skeleton by padding the skeleton; placing covering material, such as leotards and lady's knee-high stockings, over the padding; and then securing the covering material together.

9 Claims, 3 Drawing Sheets

WIRE SKELETON FOR SOFT SCULPTURED DOLLS

BACKGROUND OF THE INVENTION

1. Field of the Invention

The present invention relates to a wire skeleton for a soft sculptured doll that allows the doll to be moved and positioned similar to the movement and poses that would be possible for a small child. The wire skeleton is provided with a flexible backbone member that extends into the head of the doll, thereby allowing the chest and neck of the doll to be moved and positioned. The lower end of the flexible backbone member secures into an inverted t-shaped connector at the doll's waistline, and a unshaped wire extends through the remaining two sleeves in the horizontal portion of the t-shaped connector. The u-shaped wire forms the leg members of the doll's skeleton. The u-shaped wire freely rotates within the t-shaped connector, allowing the leg members to rotate forward and backward on the doll. Also, each of the leg members can be bent to form a foot for the doll and to simulate movement of the legs of a child so that the doll can be posed.

2. Description of the Related Art

Dolls and other animal toys have employed wire within the toy to provide movable support for the toy. However, none of the prior toys have combined the flexibility of wire for the backbone and legs of a doll with the free and coordinated movement of the dolls legs, similar to the flexibility that is found in a small child.

The present invention improves over prior toys in that it provides a movable wire backbone that extends from the doll's waistline to the doll's head and combines the backbone to an inverted t-shaped connector through which a u-shaped wire extends to form the movable and rotatable leg members of the doll.

The leg members rotate within the horizontal portion of the t-shaped connector and thereby move in conjunction with each other to the front or to the back of the doll. Also, because both the backbone and the leg member are made of flexible wire, the entire doll can be moved and posed to simulate the movement and positions that a young child would be able to achieve. This combined range of movement allows a soft sculptured doll that is made with this skeleton to be moved and posed in more realistic ways than previous dolls.

SUMMARY OF THE INVENTION

The present invention is a wire skeleton for a soft sculptured doll. The wire skeleton is provided with a flexible backbone member that extends into the head of the doll, thereby allowing the chest and neck of the doll to be moved and positioned. The backbone is provided with an upper end that extends into the head of the doll and with an opposite lower end that secures within the upward extending sleeve of an inverted t-shaped connector. The inverted t-shaped connector is located at the doll's waistline. The t-shaped connector is provided with two additional sleeves that are located at either end of a horizontal portion of the t-shaped connector. Another piece of wire that is formed into a u-shape is inserted through the horizontal portion of the t-shaped connector so that the u-shaped wire extends through the two sleeves in the horizontal portion of the t-shaped connector. The ends of the u-shaped wire form the leg members of the doll's skeleton. The unshaped wire freely rotates within the t-shaped connector, allowing the leg members to rotate forward and backward on the doll. Also, each of the leg members can be bent to form a foot for the doll and to simulate movement of the legs of a child so that the doll can be posed. The upper end of the backbone and the ends of the unshaped wire are preferably wrapped with tape to prevent the wires from poking through the padding around the skeleton of the doll and reaching the covering material of the body of the doll.

The dolls are formed employing this flexible skeleton by first placing soft pillow type padding material, such as for example polyester fiberfill, Dacron®, etc., around the skeleton of the doll. Second, a child's leotard is pulled over the bottom half of the skeleton, adding additional stuffing as needed in order to form the legs and chest of the doll. Next, a lady's knee-high stocking is pulled over the top half of the skeleton while adding additional stuffing as needed in order to form the head and neck of the doll. The lady's knee-high is inserted into the open end of the leotards and the two are secured together by sewing, gluing, or any other suitable method of attachment. Finally, two additional lady's knee-highs are filled with stuffing in order to form the arms of the doll. The open ends of the knee-highs that form the arms are secured at approximately right angles, to the neck of the doll so that the upper portion of the arms forms the doll's shoulders. The arms are secured to the neck of the doll by sewing, gluing or any other suitable means of attachment.

The doll is then dressed in children's clothing, hair or other suitable covering is applied to the head of the doll, and the arms of the doll are secured in a desired position. One preferred position for securing the doll's arms is to secure the ends of the arms to the chin of the doll to simulate a child in prayer. However, the ends of the arms may be secured within the pockets of the doll's clothing, to accessories, etc.

DETAILED DESCRIPTION OF THE PREFERRED EMBODIMENT

Wire Skeleton for Soft Sculptured Dolls

Figure 1:
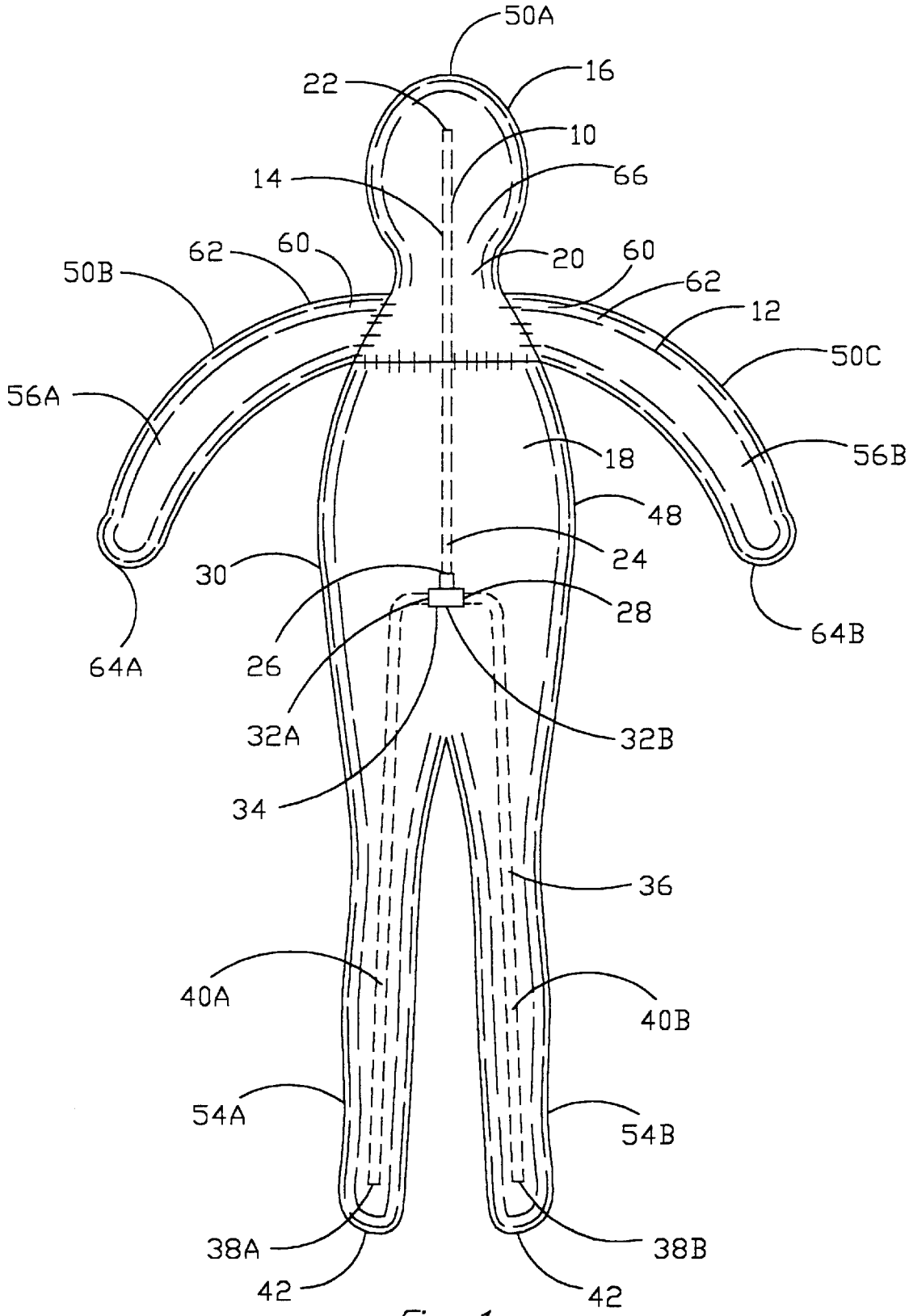
FIG. 1 is a soft sculptured doll employing a wire skeleton constructed in accordance with a preferred embodiment of the present invention.
Figure 2:
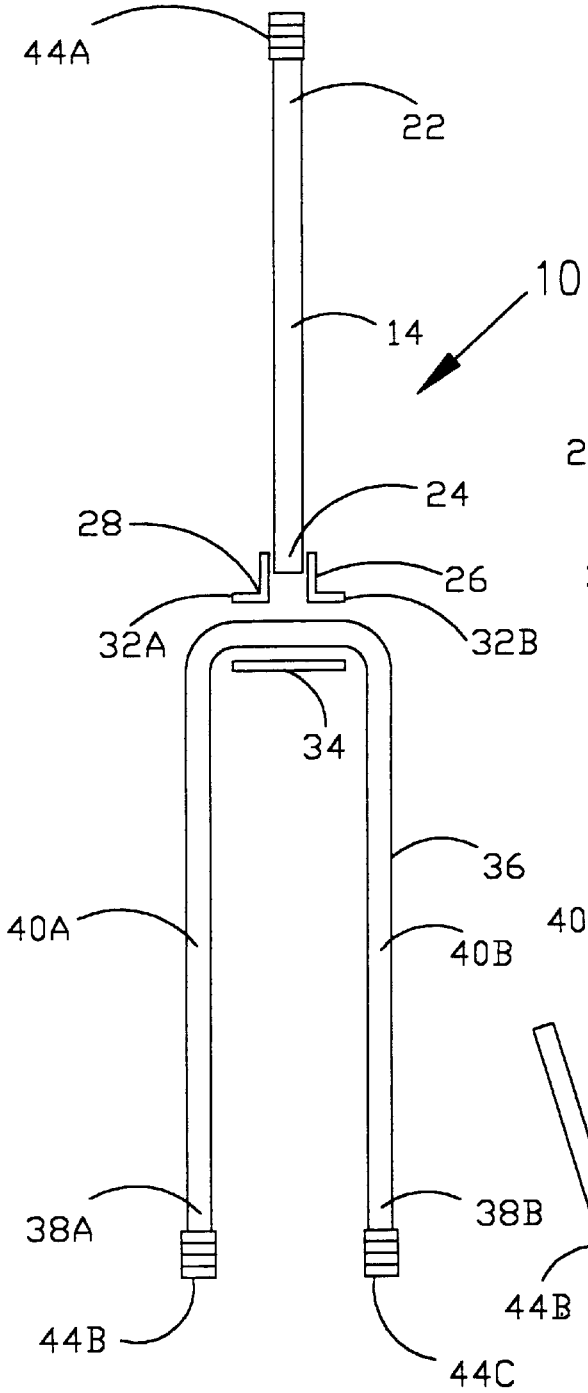
FIG. 2 is the wire skeleton employed in the doll of FIG. 1.
Figure 3:
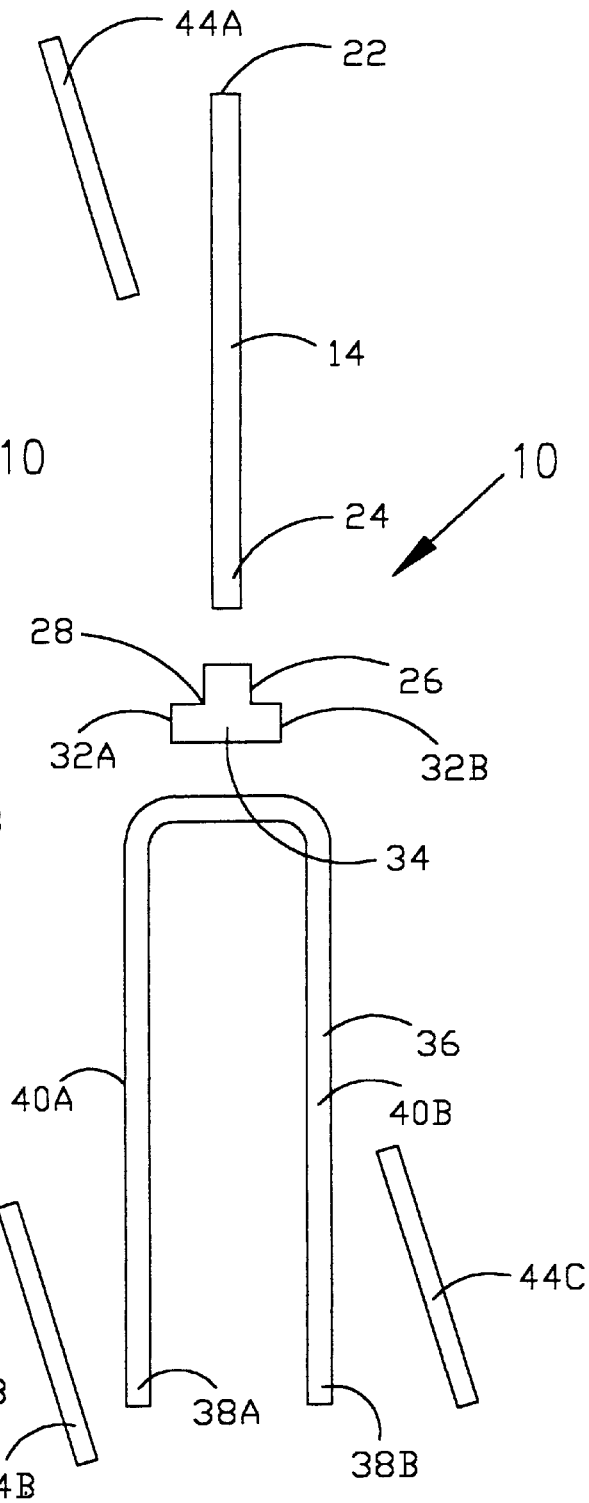
FIG. 3 is an exploded view of the wire skeleton of FIG. 2.

Referring now to FIG. 1, there is illustrated a wire skeleton 10, according to a preferred embodiment of the present invention, for use within a soft sculptured doll 12. Referring also to FIGS. 2 and 3, the wire skeleton 10 is provided with a flexible backbone member 14 that extends into the head 16 of the doll 12, thereby allowing the chest 18 and neck 20 of the doll 12 to be moved and positioned. The backbone member 14 is provided with an upper end 22 that extends into the head 16 of the doll 12 and with an opposite lower end 24 that secures within an upward extending sleeve 26 of an inverted t-shaped connector 28. The t-shaped connector 28 may be a t-shaped metal connector such as the type used for electrical conduit or a t-shaped plastic connector such as the type used in plumbing or any other suitable type of t-shaped connector. The lower end 24 may be glued within the upwardly extending sleeve 26 to permanently secure it therein.

The inverted t-shaped connector 28 is located at the waistline 30 of the doll 12. The t-shaped connector 28 is provided with two additional sleeves 32A and 32B that are located on either end of a horizontal portion 34 of the t-shaped connector 28. Another piece of wire 36 that is formed into a u-shape is inserted through the horizontal portion 34 of the t-shaped connector 28 so that the u-shaped wire 36 extends through the two sleeves 32A and 32B located in the horizontal portion 34 of the t-shaped connector 28. Ends 38A and 38B of the u-shaped wire 36 extend away from the t-shaped connector 28 and form the leg members 40A and 40B of the wire skeleton 10 for the doll 12. The u-shaped wire 36 freely rotates within the horizontal portion 34 of the t-shaped connector 28, thus allowing the leg members 40A and 40B to rotate forward and backward on the doll 12. Also, the ends 38A and 38B of each of the leg members 40A and 40B can be bent to form a foot 42 for the doll 12 and to simulate movement of the legs of a child so that the doll 12 can be posed.

The backbone member 14 and the u-shaped wire 36 are preferably constructed of heavy plastic-covered wiring, such as the three-strand, plastic-covered wiring commonly used in electrical wiring of homes when the wiring is not enclosed in conduit. Also, the upper end 22 of the backbone member 14 and the ends 38A and 38B of the u-shaped wire 36 are preferably wrapped With tape strips of tape 44A, 44B, and 44C. The tape 44A, 44B, and 44C is; to prevent the wire backbone member 14 and the u-shaped wire 36 and from poking through the padding 46 that surrounds the skeleton 10 of the doll 12 and reaching the covering materials 48, 50A, 50B, and 50C of the doll 12.

Figure 4:
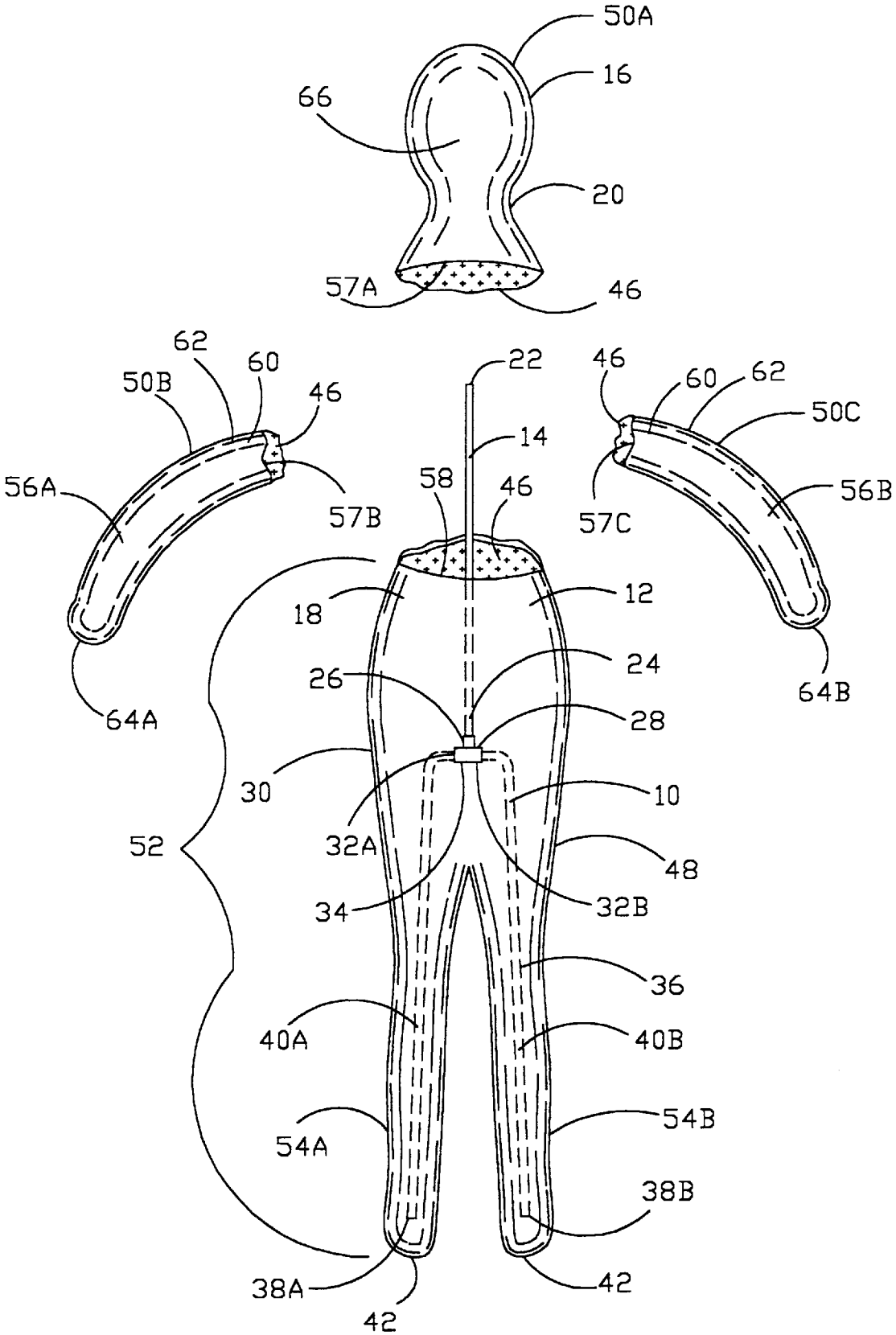
FIG. 4 is a partially constructed soft sculptured doll, shown with part of the wire skeleton exposed.

Referring now to FIG. 4, the doll 12 is formed employing this flexible skeleton 10 by first placing soft pillow type stuffing material or padding 46, such as for example polyester fiberfill, Dacron® fiber, etc., around the skeleton 10 of the doll 12. Second, a child's leotard 48 is employed for the covering material for a bottom half 52 of the doll 12. The child's leotard 48 is pulled over the bottom half 52 of the skeleton 10, adding additional padding 46 as needed in order to form legs 54A and 54B and the chest 18 of the doll 12. A first lady's knee-high stocking 50A will be the covering material for a top half of the doll, and second and third lady's knee-high stockings 50B and 50C will be the covering for arms 56A and 56B of the doll 12.

Next, the first lady's knee-high stocking 50A is pulled over the backbone member 14 of the skeleton 10, while adding additional padding 46 is added as needed in order to form the head 16 and the neck 20 of the doll 12. An open end 57A of the first lady's knee-high stocking 50A is inserted into an open waist end 58 of the leotard 48, and the stocking 50A and the leotard 48 are secured together by sewing, gluing, or any other suitable method of attachment. Finally, the two additional lady's knee-high stocking 50B and 50C are filled with padding 46 in order to form the arms 56A and 56B of the doll 12. Open ends 57B and 57C of the second and third knee-high stockings 50B and 50C are secured at approximately right angles to the neck 20 of the doll 12 so that an upper portion 60 of each of the arms 56A and 56B forms shoulders 62 on the doll 12. The arms 56A and 56B secure to the neck 20 of the doll 12 by sewing, gluing or any other suitable means of attachment.

Once the doll 12 is thus formed, it is then dressed in children's clothing (not shown). The head 16 is covered with hair or other suitable covering (not illustrated), and the arms 56A and 56B of the doll 12 are secured in a desired position. One preferred position for securing the doll's arms 56A and 56B is to secure ends 64A and 64B of the arms 56A and 56B to a chin 66 on the head 16 of the doll 12 to simulate a child in prayer. However, the ends 64A and 64B of the arms 56A and 56B may be secured within pockets of the doll's clothing, to accessories, etc.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A soft sculptured doll having a wire skeleton comprising a wire backbone member, an upper end of said wire backbone member extending internally into a head of a soft sculptured doll, an opposite lower end of said wire backbone member inserting into an upwardly extending sleeve of a t-shaped connector, a u-shaped wire rotatably extending through a horizontal portion of said t-shaped connector so that ends of the u-shaped wire protrude from sleeves provided in the horizontal portion of said t-shaped connector to form leg members for the soft sculptured doll.

2. A soft sculptured doll having a wire skeleton according claim 1 further comprising said upper end of said wire backbone member covered with tape to prevent it from poking through padding provided in a head of the doll, and said ends of the u-shaped wire being covered with tape to prevent them from poking through said padding provided in leg members of the doll.

3. A soft sculptured doll having a wire skeleton according to claim 2 further comprising a first covering material and said padding encasing said t-shaped connector and said unshaped wire to form legs of the doll, a second covering material and said padding encasing said wire backbone member to form said head and chest of the doll, said first and second covering material secured together at an open end of said first covering material, and third and fourth covering materials stuffed with padding and secured to said second covering material at open ends of said third and said fourth covering materials to form the arms and shoulders of the doll.

4. A soft sculptured doll having a wire skeleton according to claim 3 wherein said wire backbone member and said u-shaped wire are composed of plastic coated electrical wiring.

5. A soft sculptured doll having a wire skeleton according to claim 4 wherein said t-shaped connector is a t-shaped electrical conduit connector.

6. A soft sculptured doll having a wire skeleton according to claim 4 wherein said t-shaped connector is a t-shaped plumbing connector.

7. A wire skeleton for a soft sculptured doll comprising

A semi-flexible first wire form designed to the backbone of a soft sculptured doll, a lower end of said first wire secured in a sleeve of a t-shaped connector, a semi-flexible second wire rotatably extending through a horizontal portion of said t-shaped connector, and said second wire bent into a u-shape configuration so that ends of the second wire are designed to form leg members of a soft sculptured doll.

8. A wire skeleton for a soft sculptured doll according to claim 7 wherein said second wire is freely rotatable within said t-shaped connector.

9. A wire skeleton for a soft sculptured doll according to claim 8 further comprising an upper end of said first wire and both ends of said second wire being wrapped with tape.

* * * * *